US006883597B2

(12) United States Patent
Thors et al.

(10) Patent No.: US 6,883,597 B2
(45) Date of Patent: Apr. 26, 2005

(54) HEAT TRANSFER TUBE WITH GROOVED INNER SURFACE

(75) Inventors: Petur Thors, Decatur, AL (US); Ramachandran Narayanamurthy, Huntsville, AL (US)

(73) Assignee: Wolverine Tube, Inc., Huntsville, AL (US)

( * ) Notice: Subject to any disclaimer, the term of this patent is extended or adjusted under 35 U.S.C. 154(b) by 50 days.

(21) Appl. No.: 09/836,808

(22) Filed: Apr. 17, 2001

(65) Prior Publication Data

US 2002/0195233 A1 Dec. 26, 2002

(51) Int. Cl.[7] ..... F28F 19/02

(52) U.S. Cl. ..... 165/133; 165/177; 165/181; 165/183; 165/184

(58) Field of Search ..... 165/133, 181, 165/183, 184, 177; 138/38

(56) References Cited

U.S. PATENT DOCUMENTS

| | | | | | |
|---|---|---|---|---|---|
| 3,847,212 | A | | 11/1974 | Withers et al. | |
| 4,971,142 | A | * | 11/1990 | Mergler | 165/104.14 |
| 5,052,476 | A | * | 10/1991 | Sukumoda et al. | 165/133 |
| 5,332,034 | A | * | 7/1994 | Chiang et al. | 165/184 |
| 5,458,191 | A | * | 10/1995 | Chiang et al. | 165/133 |
| 5,526,663 | A | | 6/1996 | Sauvonnet et al. | |
| 5,692,560 | A | | 12/1997 | Messant et al. | |
| 5,704,424 | A | * | 1/1998 | Kohno et al. | 165/184 |
| 5,791,405 | A | | 8/1998 | Takiura et al. | |
| 5,803,165 | A | * | 9/1998 | Shikazono et al. | 165/184 |
| 5,809,647 | A | | 9/1998 | Wagner et al. | |
| 5,934,128 | A | * | 8/1999 | Takiura et al. | 72/197 |
| 5,975,196 | A | | 11/1999 | Gaffaney et al. | |
| 6,000,466 | A | | 12/1999 | Aoyagi et al. | |
| 6,164,370 | A | * | 12/2000 | Robinson et al. | 165/133 |
| 6,173,763 | B1 | * | 1/2001 | Sano et al. | 165/133 |
| 6,176,301 | B1 | * | 1/2001 | Bennett et al. | 165/133 |
| 6,308,775 | B1 | * | 10/2001 | Naumann | 165/133 |
| 6,412,549 | B1 | * | 7/2002 | Itoh et al. | 165/184 |

FOREIGN PATENT DOCUMENTS

| | | | | |
|---|---|---|---|---|
| DE | 10019975 A | | 1/2001 | |
| JP | 0280933 | * | 11/1990 | B21D/53/06 |
| JP | 406101985 A | * | 4/1994 | F28F/1/40 |
| JP | 10-115495 A | | 5/1998 | |
| JP | 11-325779 A | | 11/1999 | |

* cited by examiner

*Primary Examiner*—Henry Bennett
*Assistant Examiner*—Nihir Patel
(74) *Attorney, Agent, or Firm*—Stephen M. Schaetzel; Kristin L. Johnson; Kilpatrick Stockton LLP

(57) ABSTRACT

An improved heat transfer tube and a method of formation thereof. The inner surface of the tube has a primary set of fins and an intermediate sets of fins positioned in the areas between the primary fins and at an angle relative to the primary fins. While intermediate fins may be used with primary fins arranged in any pattern, in a preferred embodiment of the inner surface tube design, the intermediate fins are positioned relative to the primary fins to result in a grid-like appearance. Tests show that the performance of tubes having the intermediate fin designs of the present invention is significantly enhanced. A first set of rollers creates the primary and intermediate fin designs on at least one side of a board. A second set of rollers may be used to further enhance the performance. After the desired pattern has been transferred onto the board with the rollers, the board is then formed and welded into a tube, so that, at a minimum, the inner surface design of the resulting tube includes the intermediate fins as contemplated by the present invention.

40 Claims, 12 Drawing Sheets

Figure 26. Condensation Heat Transfer in R-22
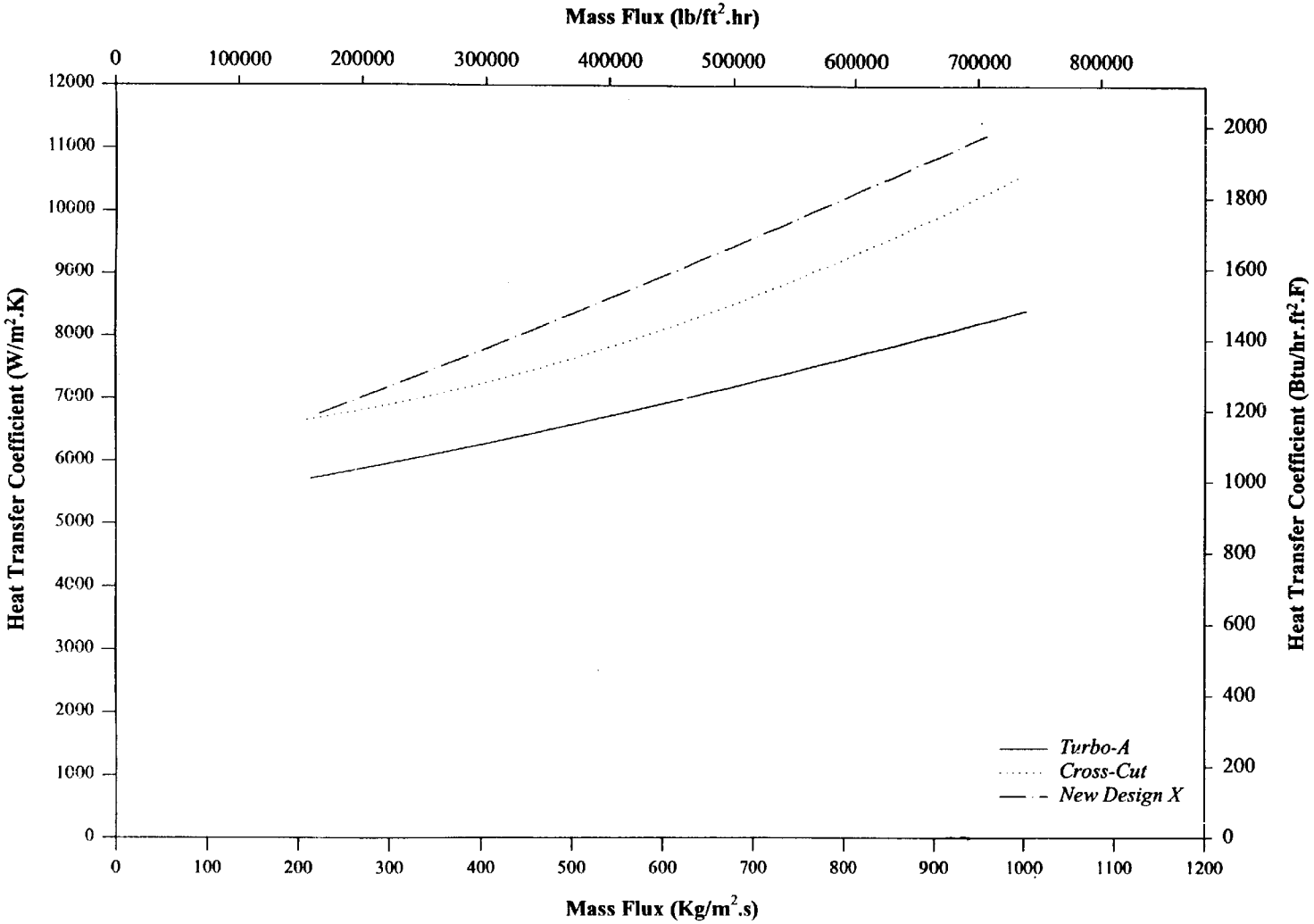

Figure 27. Condensation Pressure Drop in R-22
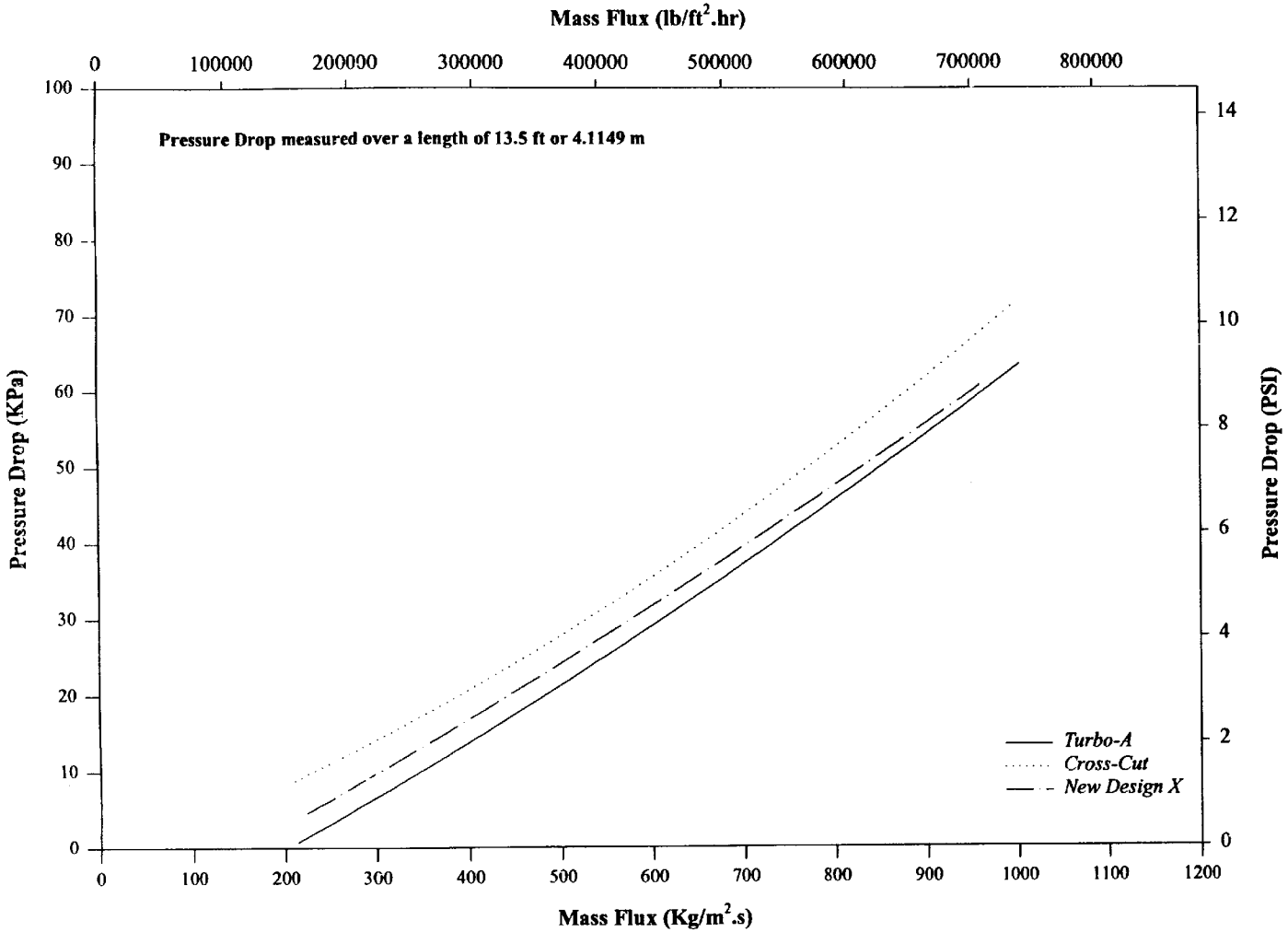

Figure 28. Condensation Heat Transfer in R-407c
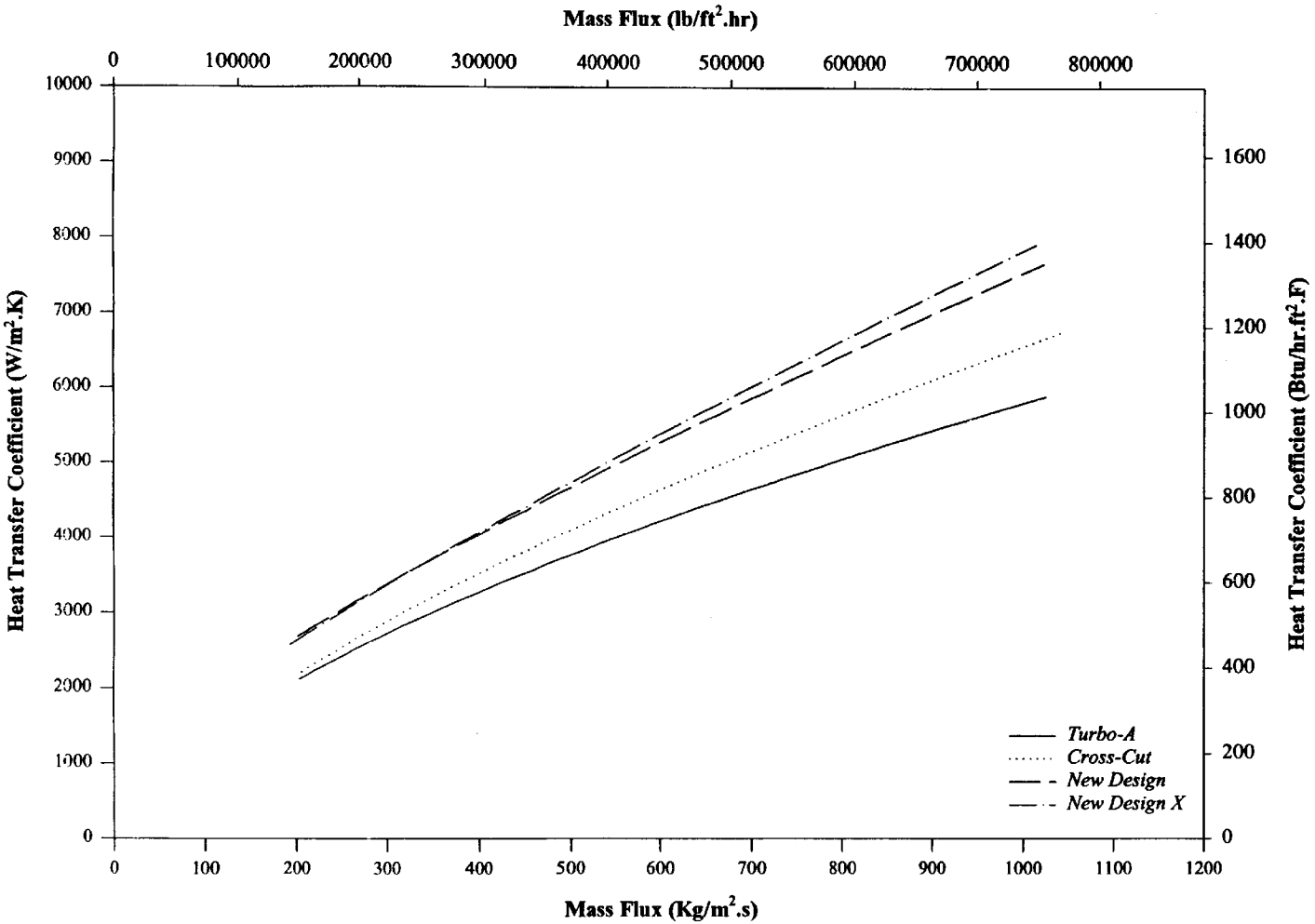

Figure 29. Condensation Pressure Drop in R-407c
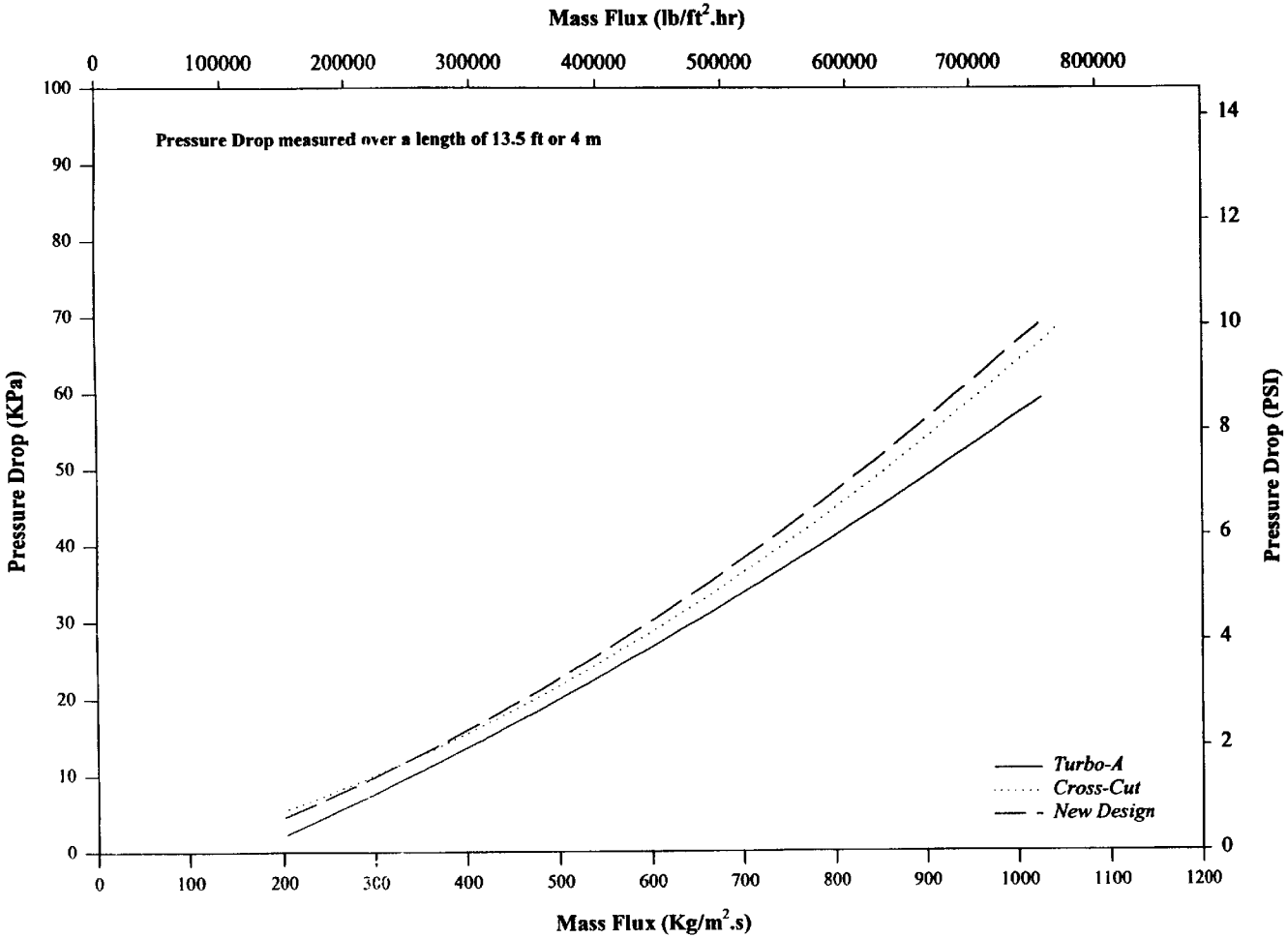

Figure 30. Efficiency in R-407c condensation compared to standard Turbo-A
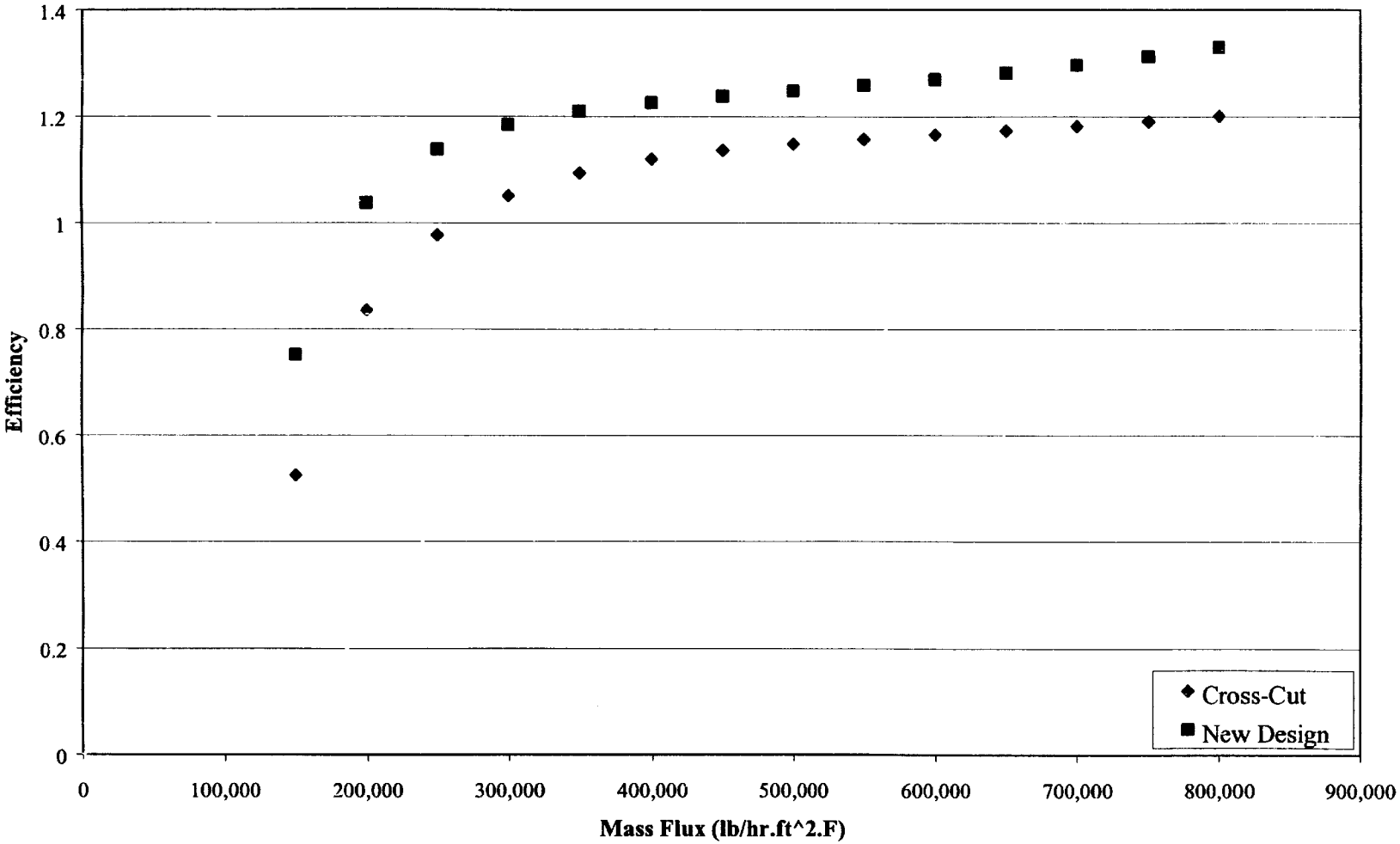

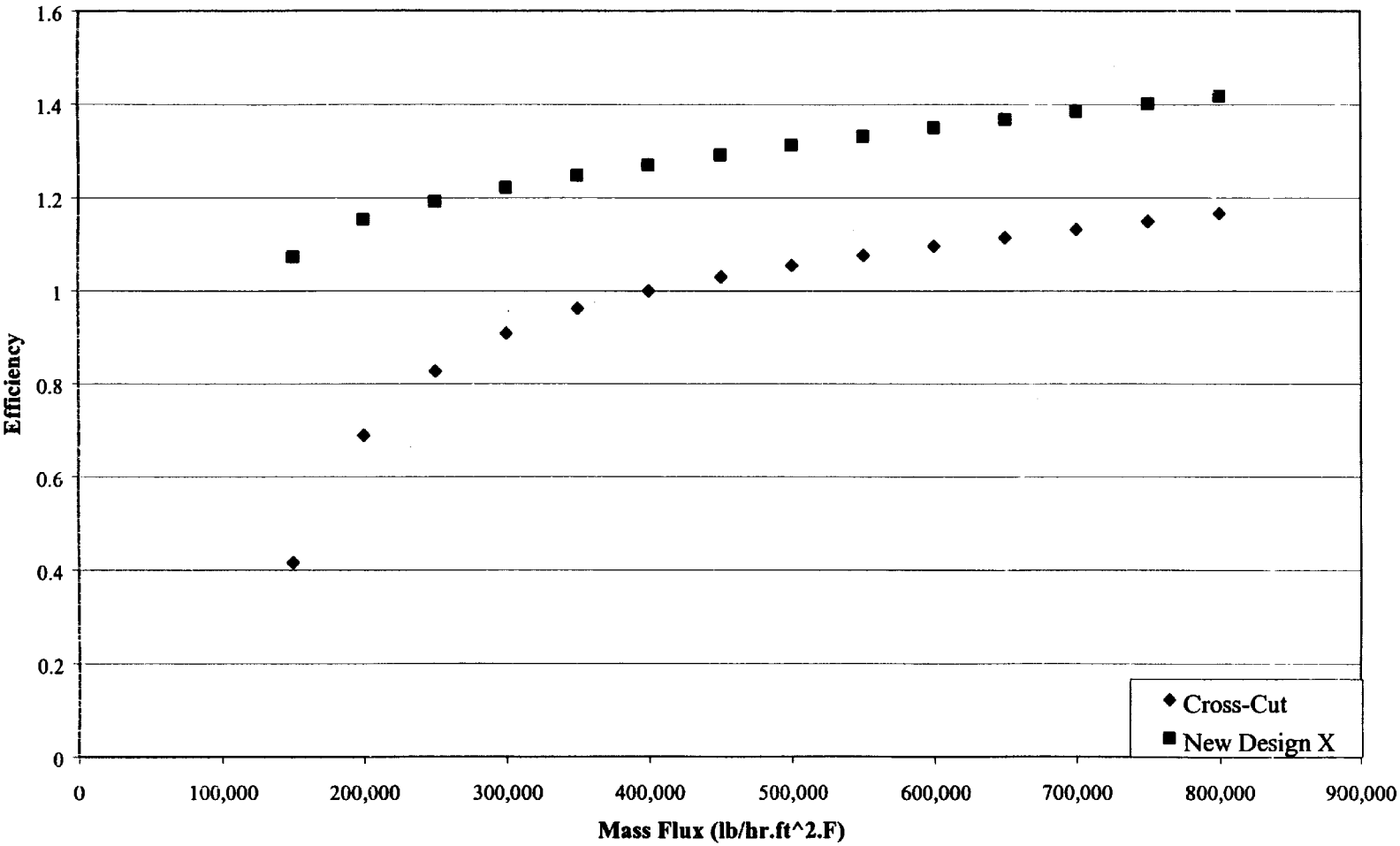
Figure 31. Efficiency of R-22 condensation compared to standard Turbo-A

HEAT TRANSFER TUBE WITH GROOVED INNER SURFACE

FIELD OF THE INVENTION

The present invention relates to heat transfer tubes that may be used in heat exchangers and other components in air conditioners, refrigerators and other such devices. The present invention relates more particularly to heat transfer tubes having grooved inner surfaces that form fins along the inner surface of the tubes for improved heat transfer performance.

BACKGROUND OF THE INVENTION

Heat transfer tubes with grooved inner surfaces are used primarily as evaporator tubes or condenser tubes in heat exchangers for air conditioning and refrigeration. It is known to provide heat transfer tubes with grooves and alternating "fins" on their inner surfaces. The grooves and the fins cooperate to enhance turbulence of fluid heat transfer mediums, such as refrigerants, delivered within the tube. This turbulence enhances heat transfer performance. The grooves and fins also provide extra surface area and capillary effects for additional heat exchange. This basic premise is taught in U.S. Pat. No. 3,847,212 to Withers, Jr. et al.

It is further known in the art to provide internally enhanced heat exchange tubes made by differing methods; namely—seamless tubes and welded tubes. A seamless tube may include internal fins and grooves produced by passing a circular grooved member through the interior of the seamless tube to create fins on the inner surface of the tube. However, the shape and height of the resulting fins are limited by the contour of the circular member and method of formation. Accordingly, the heat transfer potential of such tubes is also limited.

A welded tube, however, is made by forming a flat workpiece into a circular shape and then welding the edges to form a tube. Since the workpiece may be worked before formation when flat, the potential for varying fin height, shape and various other parameters is increased. Accordingly, the heat transfer potential of such tubes is also increased.

This method of tube formation is disclosed in U.S. Pat. No. 5,704,424 to Kohn, et al. Kohn, et al. discloses a welded heat transfer tube having a grooved inner surface. In the described and claimed production method, a flat metallic board material is rounded in the lateral direction until the side edges are brought into contact with each other. At that point, the two edges of the board material are electrically seam welded together to form the completed tube. As stated therein, an advantage of this method is that any internal fins or grooves can be embossed onto one side of the tube while the metallic board is still flat, thereby permitting increased freedom of design attributes.

Such design freedom is a key consideration in heat transfer tube design. It is a common goal to increase heat exchange performance by changing the pattern, shapes and sizes of grooves and fins of a tube. To that end, tube manufacturers have gone to great expense to experiment with alternative designs. For example, U.S. Pat. No. 5,791,405 to Takima et al. discloses a tube having grooved inner surfaces that have fins formed consecutively in a circumferential direction on the inner surface of the tube. A plurality of configurations are shown in the various drawing figures. U.S. Pat. Nos. 5,332,034 and 5,458,191 to Chiang et al. and U.S. Patent No. 5,975,196 to Gaffaney et al. all disclose a variation of this design referred to in this application as a cross-cut design. Fins are formed on the inner tube surface with a first embossing roller. A second embossing roller then makes cuts or notches cross-wise over and through the fins. This process is costly as at least two embossing rollers are required to form the cross-cut design. Moreover, the fins disclosed in all of the designs of these patents are separated by empty troughs or grooves. None of the designs capitalize on this empty area to enhance the heat transfer characteristics of the tubes.

While these inner surface tube designs aim to improve the heat transfer performance of the tube, there remains a need in the industry to continue to improve upon tube designs by modifying existing and creating new designs that enhance heat transfer performance. Additionally, a need also exists to create designs and patterns that can be transferred onto the tubes more quickly and cost-effectively. As described hereinbelow, the applicant has developed new geometries for heat transfer tubes and, as a result, significantly improved heat transfer performance.

SUMMARY OF THE INVENTION

Generally described, the present invention comprises an improved heat transfer tube and a method of formation thereof. The inner surface of the tube, after the design of the present invention has been embossed on a metal board and the board formed and welded into the tube, will have a primary set of fins and an intermediate sets of fins positioned in the areas between the primary fins and at an angle relative to the primary fins. While intermediate fins may be used with primary fins arranged in any pattern, in a preferred embodiment of the inner surface tube design, the intermediate fins are positioned relative to the primary fins to result in a grid-like appearance. Tests show that the performance of tubes having the intermediate fin designs of the present invention is significantly enhanced.

The method of the present invention comprises rolling a flat metallic board between a first set of rollers shaped to create the primary and intermediate fin designs on at least one side of the board. While previous designs with similar performance use additional roller sets, the basic designs of the present invention may be transferred onto the board using a single roller set, thereby reducing manufacturing costs. Subsequent sets of rollers may be used, however, to impart additional design features to the board. After the desired pattern has been transferred onto the board with the rollers, the board is then formed and welded into a tube, so that, at a minimum, the inner surface design of the resulting tube includes the intermediate fins as contemplated by the present invention.

Thus, it is an object of the present invention to provide improved heat transfer tubes.

It is a further object of the present invention to provide an innovative method of forming improved heat transfer tubes.

It is a further object of the present invention to provide an improved heat transfer tube having intermediate fins.

It is a further object of the present invention to provide a method of forming improved heat transfer tubes having intermediate fins.

It is a further object of the present invention to provide an improved heat transfer tube with intermediate fins that may include primary and intermediate fins of differing heights, shapes, pitches, and angles.

It is a further object of the present invention to provide an improved heat transfer tube with two sets of fins formed in one rolling operation.

It is further object of the present invention to provide an improved heat transfer tube that has at least two sets of fins having cuts cut cross-wise over and at least partially through the fins.

It is further object of the present inventions to provide an improved heat transfer tube having chambers, formed, in part, by the walls of the intermediate fins, for enhanced nucleate boiling.

These and other features, objects and advantages of the present invention will become apparent by reading the following detailed description of preferred embodiments, taken in conjunction with the drawings.

BRIEF DESCRIPTION OF THE DRAWINGS

FIG. 26 is a graph illustrating condensation heat transfer using an embodiment of the tube of the present invention with R-22 refrigerant.

FIG. 27 is a graph illustrating condensation pressure drop using an embodiment of the tube of the present invention with R-22 refrigerant.

FIG. 28 is a graph illustrating condensation heat transfer using an embodiment of the tube of the present invention with R-407c refrigerant.

FIG. 29 is a graph illustrating condensation pressure drop using an embodiment of the tube of the present invention with R-407c refrigerant.

FIG. 30 is a graph illustrating the efficiency of one embodiment of the tube of the present invention with R-407c refrigerant.

FIG. 31 is a graph illustrating the efficiency of an alternative embodiment of the tube of the present invention with R-22 refrigerant.

DETAILED DESCRIPTION OF THE DRAWINGS

Figure 1:
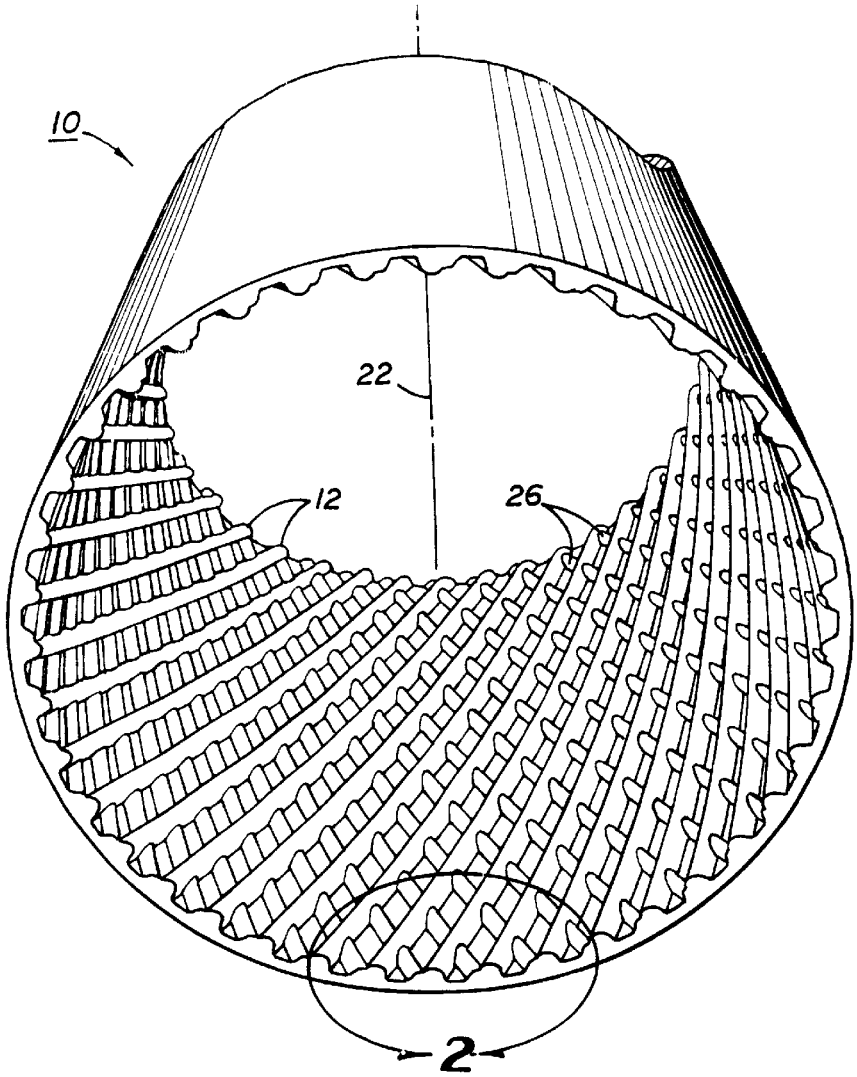
FIG. 1 is a perspective view of the inner surface of one embodiment of a tube of the present invention.
Figure 2:
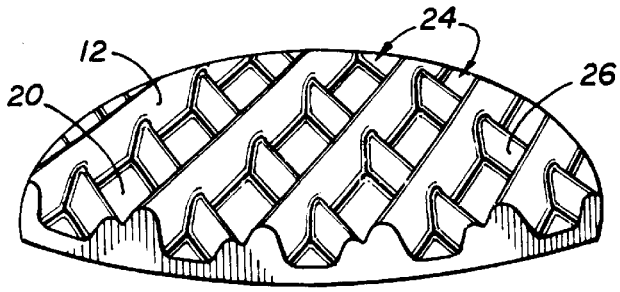
FIG. 2 is an enlarged section view taken at inset circle 2 in FIG. 1.
Figure 3:
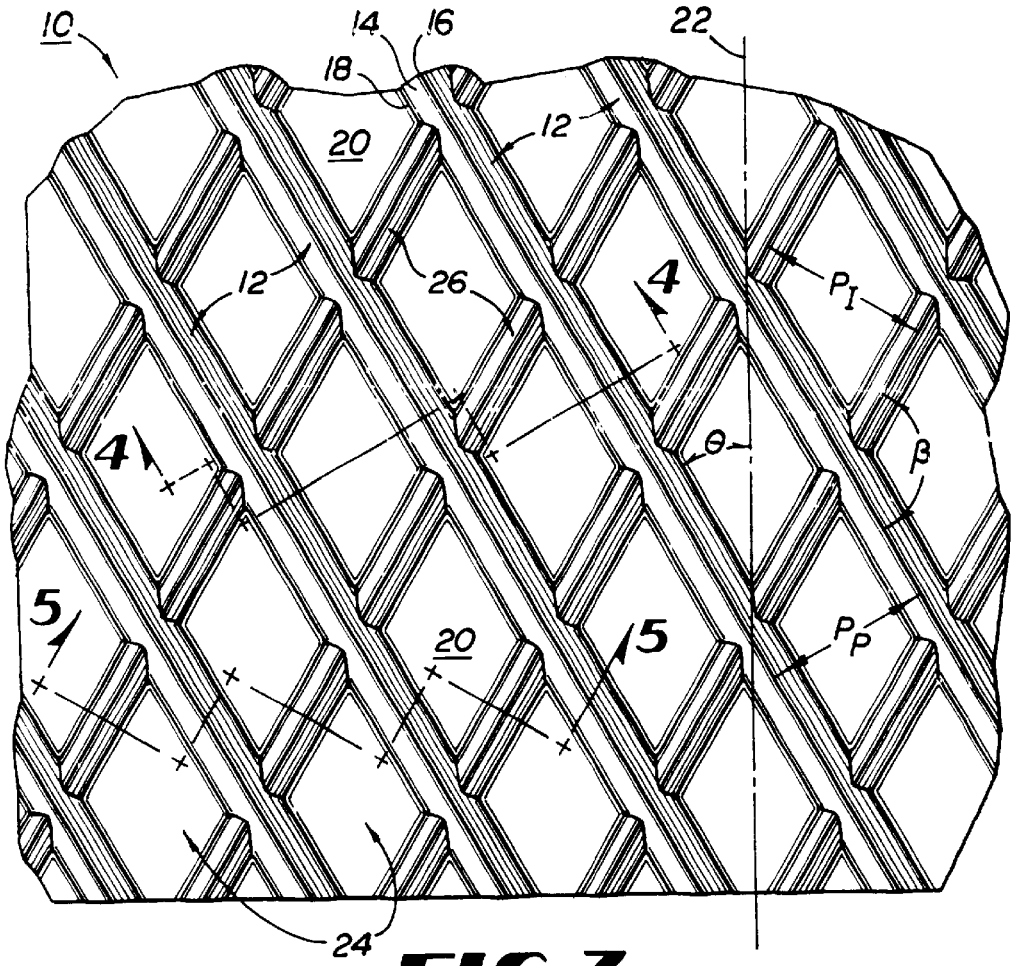
FIG. 3 is a fragmentary plan view of one embodiment of a tube of the present invention spread open to reveal the inner surface of the tube.
Figure 4:
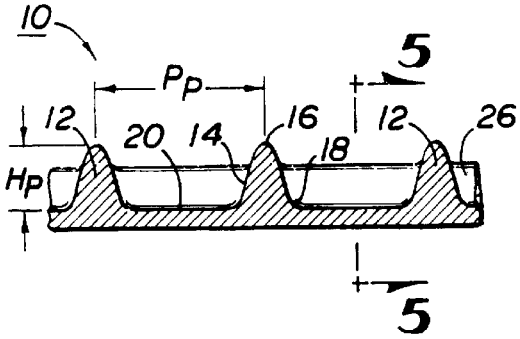
FIG. 4 is a cross-sectional view taken a long line 4—4 in FIG. 3, illustrating one embodiment of the primary fins.

Like existing designs, the inner surface design of the tube 10 of the present invention, one embodiment of which is illustrated in FIGS. 1–3, includes a set of primary fins 12 that run parallel to each other along the inner surface 20 of the tube 10. The cross-sectional shape of the primary fins 12 may assume any shape, such as those disclosed in FIGS. 6–11, but preferably is triangular-shaped, having angled, straight sides 14, a rounded tip 16, and rounded edges 18 at the interface of the sides 14 and inner surface 20 of the tube 10 (see FIG. 4). The height of the primary fins $H_P$ may vary depending on the diameter of the tube 10 and the particular application, but is preferably between 0.004–0.02 inches. As shown in FIG. 3, the primary fins 12 may be positioned at a primary fin angle θ between 0°–90° relative to the longitudinal axis 22 of the tube 10. Angle θ is preferably between 5°–50° and more preferably between 5°–300°. Finally, the number of primary fins 12 positioned along the inner surface 20 of a tube 10, and thus the primary fin pitch $P_P$ (defined as the distance between the tip or centerpoint of two adjacent primary fins measured along a line drawn perpendicular to the primary fins), may vary, depending on the height $H_P$ and shape of the primary fins 12, the primary fin angle θ, and the diameter of the tube 10. Moreover, the primary fin shape, height $H_P$, angle θ, and pitch $P_P$ may vary within a single tube 10, depending on the application.

Unlike previous designs, the designs of the present invention capitalize on the empty areas or grooves 24 between the primary fins 12 to the enhance heat transfer characteristics of the tubes. Intermediate fins 26 are formed in the grooves 24 defined by the primary fins 12 to give the inner surface tube design a grid-like appearance. The intermediate fins increase the turbulence of the fluid and the inside surface area, and thereby the heat transfer performance of the tube 10. Additionally, the intermediate fin designs contemplated by the present invention may be incorporated onto the same roller as the primary fin design, thereby reducing the manufacturing costs of the tube 10.

Figure 5:
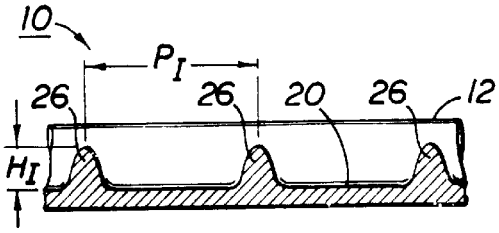
FIG. 5 is a cross-sectional view taken along line 5—5 in FIG. 3, illustrating one embodiment of the intermediate fins.
Figure 6:
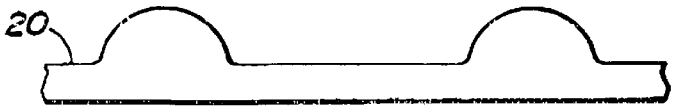
FIG. 6 is a cross-sectional view similar to FIGS. 4 and 5 showing an alternative embodiment of the shape of the primary and/or intermediate fins.
Figure 7:
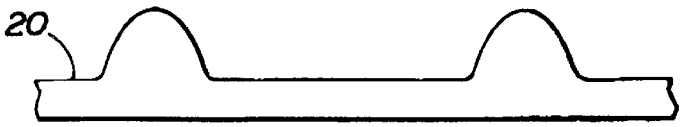
FIG. 7 is a cross-sectional view similar to FIGS. 4 and 5 showing another alternative embodiment of the shape of the primary and/or intermediate fins.
Figure 8:
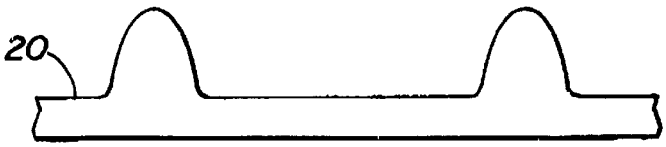
FIG. 8 is a cross-sectional view similar to FIGS. 4 and 5 showing another alternative embodiment of the shape of the primary and/or intermediate fins.
Figure 9:
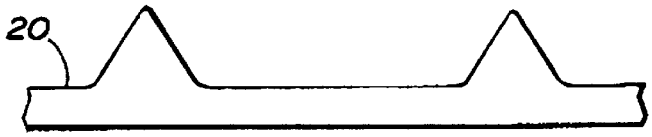
FIG. 9 is a cross-sectional view similar to FIGS. 4 and 5 showing another alternative embodiment of the shape of the primary and/or intermediate fins.
Figure 10:
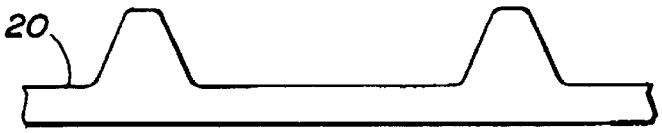
FIG. 10 is a cross-sectional view similar to FIGS. 4 and 5 showing another alternative embodiment of the shape of the primary and/or intermediate fins.
Figure 11:
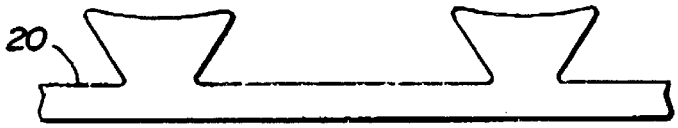
FIG. 11 is a cross-sectional view similar to FIGS. 4 and 5 showing another alternative embodiment of the shape of the primary and/or intermediate fins.

The intermediate fins 26 preferably extend the width of the groove 24 to connect adjacent primary fins 12 (as shown in FIG. 3). Just as with the primary fins 12, the intermediate fins 26 may assume a variety of shapes, including but not limited to those shown in FIGS. 5–11. The intermediate fins 26 may be, but do not have to be, shaped similar to the primary fins 12, as shown in FIG. 5. As with the primary fins 12, the number of intermediate fins 26 positioned between the primary fins 12 (and therefore the intermediate fin pitch $P_I$, defined as the distance between the tip or centerpoint of two adjacent intermediate fins measured along a line drawn perpendicular to the intermediate fins) and the height of the intermediate fins $H_I$ may be adjusted depending on the particular application. The height of the intermediate fins $H_I$ may, but do not have to, extend beyond the height of the primary fins $H_P$. As shown in FIG. 3, the intermediate fins 26 are positioned at an intermediate fin angle β measured from the counter-clockwise direction relative to the primary fins 12. Intermediate fin angle β may be any angle more than 0°, but is preferably between 45°–135°.

Figure 12:
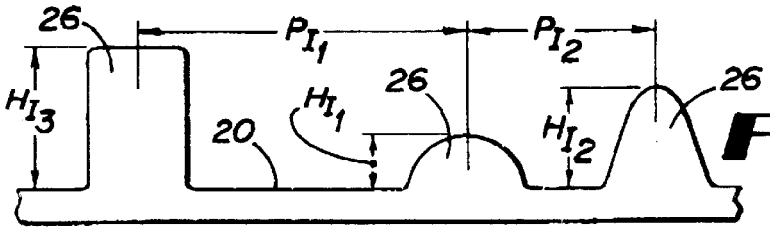
FIG. 12 is a cross-sectional view similar to FIG. 5 showing another alternative embodiment of the intermediate fins.
Figure 13:
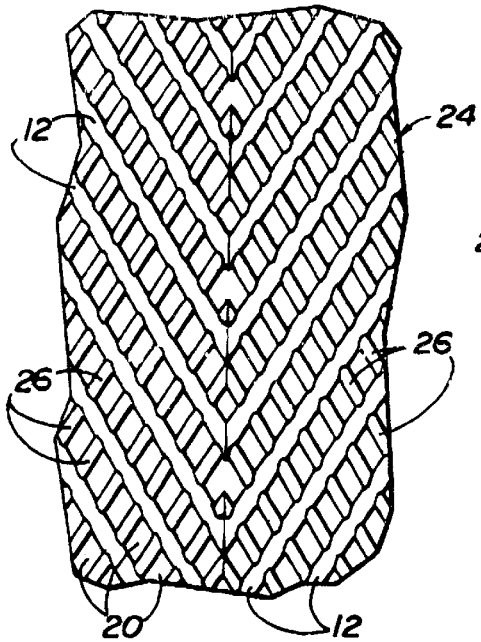
FIG. 13 is a fragmentary plan view of an alternative embodiment of a tube of the present invention spread open to reveal the inner surface of the tube.
Figure 14:
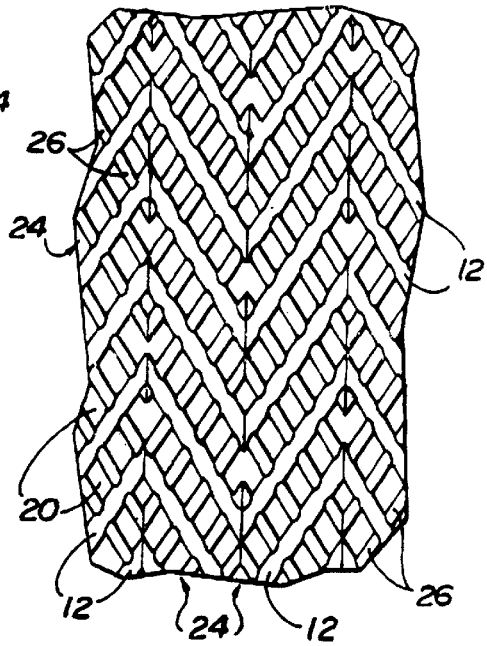
FIG. 14 is a fragmentary plan view of an alternative embodiment of a tube of the present invention spread open to reveal the inner surface of the tube.
Figure 15:
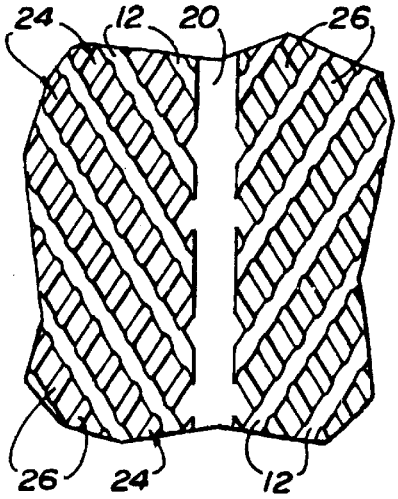
FIG. 15 is a fragmentary plan view of an alternative embodiment of a tube of the present invention spread open to reveal the inner surface of the tube.
Figure 16:
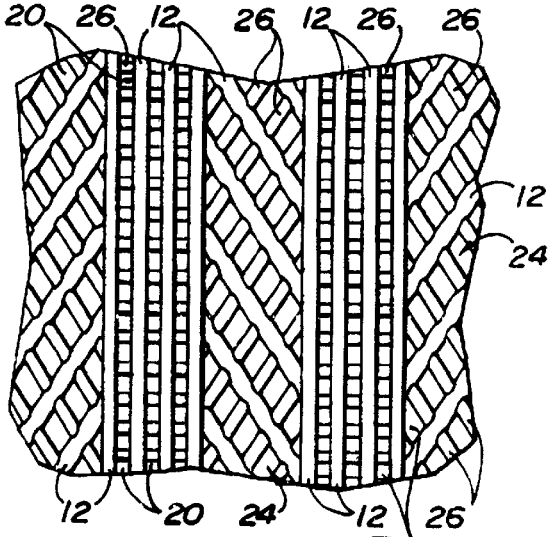
FIG. 16 is a fragmentary plan view of an alternative embodiment of a tube of the present invention spread open to reveal the inner surface of the tube.

As with the primary fins, the intermediate fin shape, height $H_I$, pitch $P_I$, and angle β need not be constant for all intermediate fins 26 in a tube 10, but rather all or some of these features may vary in a tube 10 depending on the application. For example, FIG. 12 illustrates a cross-section of a spread out tube 10 having an inner surface tube design with a variety of intermediate fin shapes, heights ($H_{I-1}$, $H_{I-2}$, and $H_{I-3}$), and pitches ($P_{I-1}$ and $P_{I-2}$).

Figure 18:
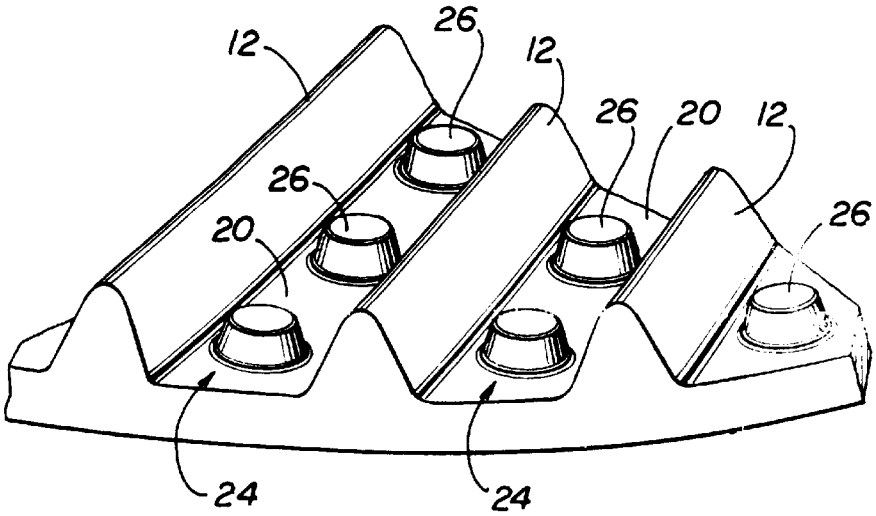
FIG. 18 is a fragmentary perspective view of the inner surface of an alternative embodiment of a tube of the present invention.

As shown in FIGS. 13–16, intermediate fins 26 may be used in conjunction with primary fins 12 arranged in any pattern, including, but not limited to, all of the patterns disclosed in U.S. Pat. No. 5,791,405 to Takima et al., the entirety of which being herein incorporated by reference. Moreover, instead of connecting adjacent primary fins 12, the intermediate fins 26 may be free-standing geometrical shapes, such as cones, pyramids, cylinders, etc. (as shown in FIG. 18).

One skilled in the art would understand how to manipulate inner surface tube design variables of the primary and intermediate fins, including fin arrangement, shape, height $H_P$ and $H_I$, angles θ and β, and pitches $P_P$ and $P_I$ to tailor the inner surface tube design to a particular application in order to obtain the desired heat transfer characteristics.

Figure 22:
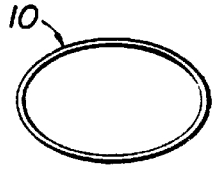
FIG. 22 illustrates an alternative cross-sectional shape of a tube of the present invention.
Figure 23:
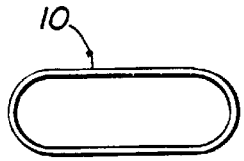
FIG. 23 illustrates an alternative cross-sectional shape of a tube of the present invention.
Figure 24:
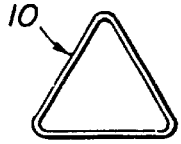
FIG. 24 illustrates an alternative cross-sectional shape of a tube of the present invention.
Figure 25:
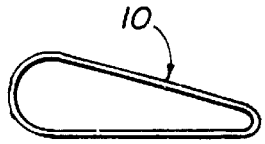
FIG. 25 illustrates an alternative cross-sectional shape of a tube of the present invention.

The tubes having patterns in accordance with the present invention may be manufactured using production methods and apparatuses well known in the art, such as those disclosed in U.S. Pat. No. 5,704,424 to Kohn, et al., the entirety of which is herein incorporated by reference. As explained in Kohn, et al., a flat board, generally of metal, is passed between sets of rollers which emboss the upper and lower surface of the board. The board is then gradually shaped in subsequent processing steps until its edges meet and are welded to form a tube 10. The tube may be formed into any shape, including those illustrated in FIGS. 20–25. While round tubes have traditionally been used and are well-suited for purposes of the present invention, enhanced heat transfer properties have been realized using tubes 10 having a cross-sectional shape flatter than traditional round tubes, such as those illustrated in FIGS. 22, 23, and 25. Consequently, it may be preferable during the shaping stage of production, but before the welding stage, to form tubes 10 having a flatter shape. Alternatively, the tubes 10 may be formed into the traditional round shape and subsequently compressed to flatten the cross-sectional shape of the tube 10. One of ordinary skill in the art would understand that the tube 10 may be formed into any shape, including but not limited to those illustrated in FIGS. 20–25, depending on the application.

The tube 10 (and therefore the board) may be made from a variety of materials possessing suitable physical properties including structural integrity, malleability, and plasticity, such as copper and copper alloys and aluminum and aluminum alloys. A preferred material is deoxidized copper. While the width of the flat board will vary according to the desired tube diameter, a flat board having a width of approximately 1.25 inches to form a standard ⅜" tube outside diameter is a common size for the present application.

Figure 19:
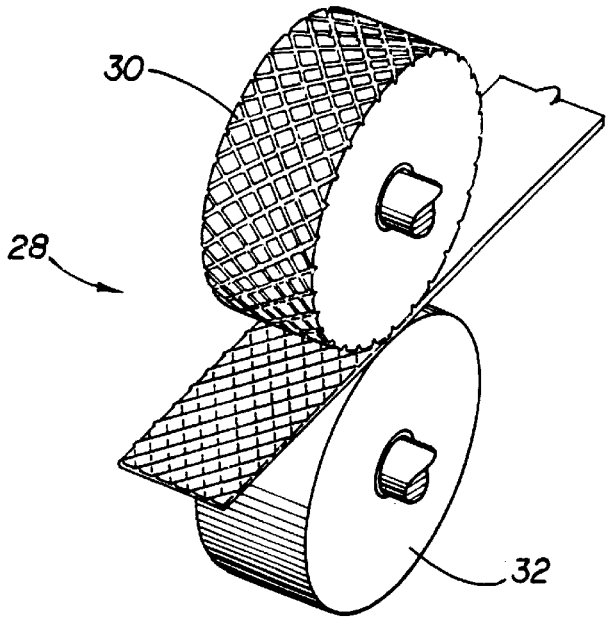
FIG. 19 is a perspective view of the fin-forming rollers used to produce one embodiment of the tube of the present invention.
Figure 20:
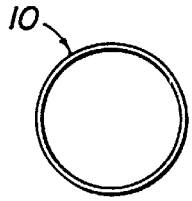
FIG. 20 illustrates a cross-sectional shape of a tube of the present invention.
Figure 21:
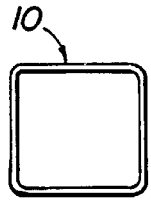
FIG. 21 illustrates an alternative cross-sectional shape of a tube of the present invention.

To form the desired pattern on the board, the board is passed through a first set of deforming or embossing rollers 28, which consists of an upper roller 30 and a lower roller 32 (see FIG. 19). The pattern on the upper roller 30 is an interlocking image of the desired primary and intermediate fin pattern for the inner surface of the tube 10 (i.e. the pattern on the upper roller interlocks with the embossed pattern on the tube). Similarly, the pattern of the lower roller 32 is an interlocking image of the desired pattern (if any) of the outer surface of the tube 10. FIG. 19 illustrates one set of rollers 28, the upper roller 30 having a pattern that includes an intermediate fin design as contemplated by the present invention.

The patterns on the rollers may be made by machining grooves on the roller surface. As will be apparent to one of ordinary skill in the art, because of the interlocking-image relationship between the rollers and the board, when the board is passed through the rollers, the grooves on the rollers form fins on the board and the portions of the roller surface not machined form grooves on the board. When the board is subsequently rolled and welded, the desired inner and outer patterns are thereby located on the tube.

An advantage of the tubes formed in accordance with the present invention is that the primary and intermediate fin designs of the tubes may be machined on the roller and formed on the board with a single roller set, as opposed to the two sets of rollers (and consequently two embossing steps) that have traditionally been necessary to create existing inner surface tube designs, such as the cross-cut design, that enhance tube performance. Elimination of a roller set and embossing stage from the manufacturing process can reduce the manufacturing time and cost of the tube.

Figure 17:
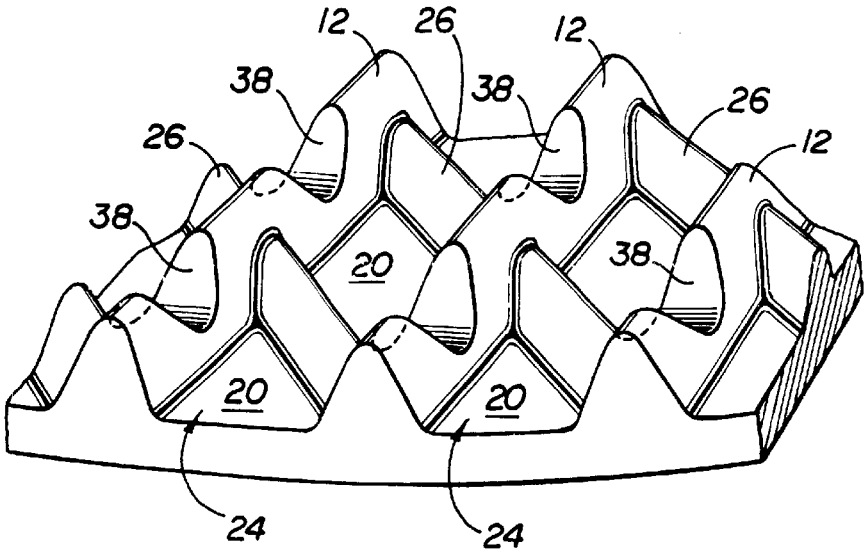
FIG. 17 is a fragmentary perspective view of the inner surface of an alternative embodiment of a tube of the present invention.

However, while only one roller set is necessary to create the primary and intermediate fin designs of the present invention, subsequent and additional rollers may be used impart additional design features to the board. For example, a second set of rollers may be used to make cuts 38 cross-wise over and at least partially through the fins to result in a cross-cut design, as shown in FIG. 17.

In an alternative design, the primary and intermediate fins form the sidewalls of a chamber. The tops of the primary fins may be formed, such as, for example, by pressing them with a second roller, to extend or flare laterally to partially, but not entirely, close the chamber. Rather, a small opening through which fluid is able to flow into the chamber remains at the top of the chamber. Such chambers enhance nucleate boiling of the fluid and thereby improve evaporation heat transfer.

In addition to potentially reducing manufacturing costs, tubes having designs in accordance with the present invention also outperform existing tubes. FIGS. 26–29 graphically illustrate the enhanced performance of such tubes in condensation obtainable by incorporating intermediate fins into the inner surface tube design. Performance tests were conducted on four condenser tubes for two separate refrigerants (R-407c and R-22). The following copper tubes, each of which had a different inner surface design, were tested:

(1) "Turbo-A," a seamless or welded tube made by Wolverine Tube for evaporator and condenser coils in air conditioning and refrigeration with internal fins that run parallel to each other at an angle to the longitudinal axis of the tube along the inner surface thereof (designated "Turbo-A");

(2) a cross-cut tube made by Wolverine Tube for evaporator and condenser coils (designated "Cross-Cut");

(3) a tube with an intermediate fin design in accordance with the present invention (designated "New Design"); and (4) a tube with an intermediate fin design in accordance with the present invention whereby the primary and intermediate fins have been cross-cut with a second roller (designated "New Design X").

FIGS. 26 and 27 reflect data obtained using R-22 refrigerant. FIGS. 28 and 29 reflect data obtained using R-407 refrigerant. The general testing conditions represented by these graphs are as follows:

| | Evaporation | Condensation |
|---|---|---|
| Saturation Temperature | 35° (1.67° C.) | 105° F. (40.6° C.) |
| Tube Length | 12 ft (3.66 m) | 12 ft (3.66 m) |
| Inlet Vapor Quality | 10% | 80% |
| Outlet Vapor Quality | 80% | 10% |

The data was obtained for flowing refrigerant at different flow rates. Accordingly, the "x" plane of all the graphs is expressed in terms of mass flux (lb./hr. $ft^2$). FIGS. 26 and 28 show heat transfer performance. Accordingly, the "y" plane of these two graphs is expressed in terms of heat transfer co-efficient (Btu/hr. $ft^2$). FIGS. 27 and 29 show pressure drop information. Accordingly, the "y" plane of these two graphs is expressed in terms of pressure per square inch (PSI).

The data for the R-407c refrigerant (FIGS. 28 and 29), which is a zeotropic mixture, indicates that the condensation heat transfer performance of the New Design is approximately 35% improved over the Turbo-A design. Further, the New Design provides increased performance (by approximately 15%) over the standard Cross-Cut design, which is currently regarded as the leading performer in condensation performance among widely commercialized tubes. In terms of pressure drop performance, the New Design performs as well as the Turbo-A design and approximately 10% lower than the standard Cross-Cut design. The pressure drop is a very important design parameter in heat exchanger design. With the current technology in heat exchangers, a 5% decrease in pressure drop can sometimes provide as much benefit as a 10% increase in heat transfer performance.

The new design makes use of an interesting phenomenon in two-phase heat transfer. In a tube embodiment of the present invention, where a fluid is condensing on the inside of the tube, the pressure drop is mainly regulated by the liquid-vapor interface. The heat transfer is controlled by the liquid-solid interface. The intermediate fins affect the liquid layer, thereby increasing the heat transfer, but do not impact the pressure drop. The relationship between the heat transfer and pressure drop is captured by the efficiency factor.

With use of the R-22 refrigerant (FIGS. 26 and 27), the New Design X outperformed the Turbo-A and Cross-Cut designs with respect to heat transfer by nearly the same percentages as the New Design did in the R-407c tests. The inventor has no reason to believe that similar performance improvement will not be obtained using other refrigerants such as R-410(a) or R-134(a), and other similar fluids.

FIGS. 30 and 31 compare the efficiency factors of the Cross-Cut design with the efficiency factors of the New Design (FIG. 30) and the New Design X (FIG. 31). The efficiency factor is a good indicator of the actual performance benefits associated with a tube inner surface because it reflects both the benefit of additional heat transfer and the drawback of additional pressure drop. In general, the efficiency factor of a tube is defined as the increase in heat transfer of that tube over a standard tube (in this case, the Turbo-A) divided by the increase in pressure drop of that tube over the standard tube. The efficiency factors plotted in FIGS. 30 and 31 for the Cross-Cut were calculated as follows:

$$\frac{(\text{Heat Transfer of Cross-Cut}/\text{Heat Transfer of Turbo-A})}{(\text{Pressure Drop of Cross-Cut}/\text{Pressure Drop of Turbo-A})}$$

The efficiency factors of the New Design and the New Design X, plotted in FIGS. 30 and 31, respectively, were similarly calculated.

As can be seen in FIGS. 30 and 31, the efficiency factors for the New Design and the New Design X are all (with the exception of one) above "1", which indicates that the efficiency of both of these new designs is better than that of the standard Turbo-A by as much as 40% in R-22 condensation (FIG. 31) and by up to 35% in R-407c condensation (FIG. 30). Moreover, by comparing the efficiency factors of the Cross-Cut (FIGS. 30 and 31) plotted against the New Design (FIG. 30) and New Design X (FIG. 31), it is apparent that the efficiencies of the new designs are consistently better than the Cross-Cut tube by 20% in R-22 condensation (FIG. 31) and 10% in R-407c condensation (FIG. 30).

Thus it is seen that a tube providing intermediate fins represents a significant improvement over cross-cut and single helical ridge designs. This new design thus advances the state of the art. It will be understood by those of ordinary skill in the art that various modifications may be made to the preferred embodiments within the spirit and scope of the invention as defined by the appended claims.

We claim:

1. A tube comprising an inner surface and an outer surface, wherein the inner surface comprises a plurality of primary fins, a plurality of intermediate fins, and a plurality of grooves defined by adjacent primary fins, wherein the plurality of intermediate fins are positioned in at least some of the plurality of grooves and form a grid-like pattern on the inner surface of the tube, wherein at least a first portion of primary fins and intermediate fins is separated from at least a section portion of primary fins and intermediate fins by a channel that runs along a portion of the length of the inner surface of the tube.

2. The tube of claim 1, wherein the tube comprises metal.

3. The tube of claim 1, further comprising a non-metallic material.

4. The tube of claim 1, wherein the tube comprises a circular cross-sectional shape.

5. The tube of claim 1, wherein the outer surface of the tube is smooth.

6. The tube of claim 1, wherein the outer surface of the tube is contoured.

7. The tube of claim 1, wherein at least some of the plurality of primary fins are oriented parallel to each other.

8. The tube of claim 1, wherein the plurality of primary fins comprises a first set of adjacent primary fins having a first primary fin pitch and a second set of adjacent primary fins having a second primary fin pitch, wherein the first primary fin pitch is not equal to the second primary fin pitch.

9. The tube of claim 1, wherein at least some of the plurality of primary fins have a cross-sectional shape comprising substantially a triangle with a rounded tip.

10. The tube of claim 1, wherein at least some of the plurality of primary fins have a substantially rectilinear cross-sectional shape.

11. The tube of claim 1, wherein at least some of the plurality of primary fins have a generally curved cross-sectional shape.

12. The tube of claim 1, further comprising a longitudinal axis, wherein at least some of the plurality of primary fins are oriented an angle relative to the longitudinal axis.

13. The tube of claim 12, wherein at least some of the plurality of primary fins are oriented an angle between 5°–30° relative to the longitudinal axis.

14. The tube of claim 13, wherein at least some of the plurality of primary fins are oriented an angle between 5°–30° relative to the longitudinal axis.

15. The tube of claim 1, wherein at least some of the plurality of primary fins further comprise cuts that traverse the width of the primary fins.

16. The tube of claim 1, wherein at least some of the plurality of intermediate fins contact adjacent primary fins.

17. The tube of claim 1, wherein the plurality of intermediate fins comprises a first set of adjacent intermediate fins having a first intermediate fin pitch and a second set of adjacent intermediate fins having a second intermediate fin pitch, wherein the first intermediate fin pitch is not equal to the second intermediate fin pitch.

18. The tube of claim 1, wherein at least some of the plurality of intermediate fins are oriented at an angle relative to at least some of the primary fins.

19. The tube of claim 18, wherein at least some of the plurality of intermediate fins are oriented at an angle between 45°–135° relative to at least some of the primary fins.

20. The tube of claim 1, wherein at least some of the plurality of intermediate fins comprise a free-standing geometrical shape positioned in the groove.

21. The tube of claim 1, wherein at least some of the plurality of intermediate fins have a cross-sectional shape comprising substantially a triangle with a rounded tip.

22. The tube of claim 1, wherein at least some of the plurality of intermediate fins have a substantially rectilinear cross-sectional shape.

23. The tube of claim 1, wherein at least some of the plurality of intermediate fins have a generally curved cross-sectional shape.

24. The tube of claim 1, wherein at least some of the plurality of intermediate fins further comprise cuts that traverse the width of the intermediate fins.

25. A tube comprising an inner surface and a longitudinal axis, wherein the inner surface comprises:

a. a plurality of primary fins, wherein at least some of the plurality of primary fins are oriented substantially parallel to each other and wherein at least some of the plurality of primary fins are oriented at an angle relative to the longitudinal axis wherein the plurality of primary fins is divided into a first portion of primary fins and a second portion of primary fins;

b. a plurality of grooves defined by adjacent primary fins;

c. a plurality of intermediate fins, wherein the plurality of intermediate fins are positioned in at least some of the plurality of grooves and wherein at least some of the intermediate fins are oriented at an angle relative to at least some of the primary fins; and d. a trenched groove that runs between the first portion of primary fins and the second portion of primary fins.

26. The tube of claim 1, wherein the tube comprises a substantially oval cross-sectional shape.

27. The tube of claim 1, wherein the tube has a cross-sectional shape comprising two substantially parallel lines connected by arcs.

28. The tube of claim 1, wherein the plurality of primary fins comprises a first set and a second set of primary fins, the plurality of grooves comprises a first set of grooves defined by the first set of primary fins and a second set of grooves defined by the second set of primary fins, and the plurality of intermediate fins comprises a first set of intermediate fins positioned in at least some of the first set of grooves and a second set of intermediate fins positioned in at least some of the second set of grooves, wherein the first set of primary fins is oriented at an angle with respect to the second set of primary fins.

29. The tube of claim 28, wherein the first set of primary fins and the second set of primary fins intersect.

30. The tube of claim 28, wherein the first set of primary fins and the second set of primary fins are separated by at least one channel that runs along a portion of the length of the inner surface of the tube.

31. A heat transfer tube comprising an inner surface and an outer surface, wherein the inner surface comprises:

a. two sets of fins, comprising (i) a plurality of adjacent primary fins defining a groove between adjacent primary fins; and (ii) a plurality of short, intermediate fins positioned in at least some of the grooves between the adjacent primary fins, wherein the plurality of short intermediate fins are provided in a number greater than the number of adjacent primary fins; and b. a channel dividing the two set of fins providing a trench for fluid heat transfer mediums to flow between the two sets of fins.

32. The tube of claim 31, wherein at least some of the plurality of short, intermediate fins are oriented at an angle relative to at least some of the adjacent primary fins.

33. The tube of claim 32, wherein at least some of the plurality of short, intermediate fins are oriented at an angle between 45°–135° relative to at least some of the adjacent primary fins.

34. A tube comprising an inner surface and an outer surface, wherein the inner surface comprises:

a. a first set of a plurality of primary fins positioned substantially parallel to one another and defining (i) a plurality of primary fin axes and (ii) a first set of grooves between each set of adjacent primary fins;

b. a first set of a plurality of intermediate fins provided in an amount greater than the amount of the first set of primary fins, wherein the first set of a plurality of intermediate fins is positioned substantially parallel to one another in at least some of the first set of grooves, c. a second set of a plurality of primary fins positioned substantially parallel to one another and spaced apart from the first set of primary fins by a channel, wherein the second set of a plurality of primary fins define (i) a plurality of primary fin axes and (ii) a second set of grooves between each set of adjacent primary fins;

d. a second set of a plurality of intermediate fins provided in an amount greater than the amount of the second set of primary fins, wherein the second set of a plurality of intermediate fins is positioned substantially parallel to one another in at least some of the second set of grooves, and e. a channel that separates the first set of primary and intermediate fins from the second set of primary and intermediate fins.

35. The tube of claim 34, wherein at least some of the plurality of intermediate fins are oriented at an angle relative to at least some of the adjacent primary fins.

36. The tube of claim 35, wherein at least some of the plurality of intermediate fins are oriented at an angle between 45°–135° relative to at least some of the adjacent primary fins.

37. The tube of claim 1, further comprising a plurality of first portions of primary fins and intermediate fins separated from a plurality of section portions of primary fins and intermediate fins by a plurality of channels.

38. The tube of claim 25, further comprising more than one trenched groove dividing more than one first and second portions of primary fins.

39. The tube of claim 31, further comprising more than two sets of fins, wherein each set of fins is divided by a channel.

40. The tube of claim 34, further comprising a plurality of first and second sets separated by a plurality of channels.

* * * * *